US005396774A

United States Patent [19]

Hubbell, Jr.

[11] Patent Number: 5,396,774

[45] **Date of Patent: * Mar. 14, 1995**

[54] BY-PASS MANIFOLD VALVE FOR CHARGING, REPAIRING AND/OR TESTING REFRIGERANT SYSTEMS

[75] Inventor: Paul J. Hubbell, Jr., 405 Faun St., Metairie, La. 70003

[73] Assignees: Paul J. Hubbell, Jr.; Pollution Reduction, Inc.; Steven J. Hubbell, all of Metairie, La. ; a part interest

[ * ] Notice: The portion of the term of this patent subsequent to Dec. 22, 2009 has been disclaimed.

[21] Appl. No.: 980,479

[22] Filed: Nov. 23, 1992

Related U.S. Application Data

[63] Continuation-in-part of Ser. No. 120,525, Nov. 13, 1987, Pat. No. 5,172,557.

[51] Int. Cl.[6] ..... F25B 45/00

[52] U.S. Cl. ..... 62/77; 62/192; 62/292

[58] Field of Search ..... 62/192, 292, 149, 298, 62/77

[56] References Cited

U.S. PATENT DOCUMENTS

| | | | |
|---|---|---|---|
| 3,785,163 | 1/1974 | Wagner | 62/77 |
| 3,916,641 | 11/1975 | Mullins | 62/292 |
| 3,916,947 | 11/1975 | Holmes et al. | 137/544 |
| 3,935,713 | 2/1976 | Olson | 62/77 |
| 3,996,765 | 11/1975 | Mullins | 62/292 |
| 5,172,557 | 12/1992 | Hubbell | 62/292 X |

*Primary Examiner*—Henry A. Bennet
*Attorney, Agent, or Firm*—C. Emmett Pugh

[57] ABSTRACT

Two embodiments (FIGS. 1+ & FIGS. 5+) of a double, by-pass valve system for a closed refrigerant system allowing its safe servicing, the first being included in the original manufacturing of the compressor unit in the refrigerant exit line of the compressor (FIG. 4 ) and the second installed as a retro-fit on the compressor unit and provided "in-line" in the liquid refrigerant line. In the first a double valve body with a transverse bore through a main shut-off valve allows the flow of refrigerant to pass or be shut down to the rest of the system, while a secondary, access port with a transverse bore intersects the main flow valve on the upstream side of the seats by means of a manifold bore, providing a by-pass passageway to an access connection (minus a depressible valve core or "Schrader" valve) for a refrigerant hose to connect to the manifold charging gauges, allowing communication with the closed refrigerant system. Additionally, liquid refrigerant is by-passed into the evaporator coil for storage while repairing the condenser, and also individual sides of the system may be pulled on a vacuum independently to test for leaks. The second embodiment uses two, structurally independent, spaced valves connected by a "tee" to the refrigerant liquid line, forming a by-pass between the two valves. Also taught are methods for entering a closed system for testing, charging and exiting it, vacuum processing to vacuum the entire system and either the high or low sides of it simultaneously, and for the storage and transfer of the system refrigerant.

13 Claims, 4 Drawing Sheets

BY-PASS MANIFOLD VALVE FOR CHARGING, REPAIRING AND/OR TESTING REFRIGERANT SYSTEMS

REFERENCE TO RELATED APPLICATION

The present application is a continuation-in-part of pending patent application Ser. No. 07/120,525, filed Nov. 13, 1987, entitled "By Pass Manifold Valve for Charging, Repairing and/or Testing Refrigerant Systems," which application has been allowed as U.S. Pat. No. 5,172,557, the disclosure of which is incorporated herein by reference, including the disclosures of the responses and amendments filed therein.

TECHNICAL FIELD

The present invention relates to a closed refrigeration system and more particularly to adding or including a by-pass system therefor. In a first, exemplary embodiment the by-pass system includes valved fittings having two capped, threaded stems extending from, for example, two parallel, elongated manifolds intersected by a transverse manifold, typically at a ninety (90°) degree angle, upstream from the liquid shut-off valve and shut-off seat of the main flow valve of the refrigeration system. The present invention also relates to associated methods for servicing, installing, testing or vacuuming the system and/or removing, storing or adding fluid refrigerant to the system.

In the context of this specification the phrases "refrigerating system," "refrigeration system" or "refrigerant system," as used herein, relates to the current and future, state-of-the-art systems that use compressible evaporative refrigerants to transfer heat, e.g., refrigerators, freezers, chillers and other air conditioning units, including residential, commercial, automotive and other mobile types.

The maintenance of such systems requires that the refrigerant system be tested and additional refrigerant fluid be added thereto if the fluid contained in the system is below a predetermined pressure. Also, the refrigerant must sometimes be removed from the system in order to effect repairs, and the system must then be recharged.

Installation, maintenance, testing and/or repairs of such pressurized systems and the infusion of additional refrigerant fluids to said systems require that a valve device or means be installed in the system to accomplish such work without the evaporative fluid in the enclosed space escaping from the system in order that the work can be performed in a safe, economical, efficient and environmentally protective manner.

The present invention, termed the "Hubbell-Double" TM valve, provides a means to accomplish the aforesaid purposes that is simple to install in a refrigerating system and is simple to construct and inexpensive to manufacture.

BACKGROUND ART

Many refrigeration and air conditioning systems, especially residential and mobile systems, have threaded fittings in which a threaded check valve core is installed to provide access to the system. Such threaded check valves are of the type commonly used in automobile tire valve stems and are often referred to as "Schrader" type (depressing) valve cores. Most have no shut-off valves, thus allowing a loss of refrigerant when connecting or disconnecting charging hoses, which results in unsafe, wasteful and harmful emissions into the atmosphere (causing, e.g., ozone depletion), in addition to unbalanced refrigerant charges in the system which causes the system to be inefficient. Present systems do not allow the independent vacuum process of both the condenser and evaporator section of the system simultaneously.

Other common problems, in the proper maintenance and repair of refrigeration systems, are the means to check the system to determine the location of leaks and the inability to perform repairs or other work on the condenser unit without "blowing the charge" or venting the refrigerant charge into the atmosphere.

The prior art contains a number of teachings of servicing tools and/or means to provide access to a closed refrigeration system, e.g., those disclosed in U.S. Pat. No. 3,935,713 issued to John W. Olson (1976), U.S. Pat. No. 3,916,947 issued to Paul M. Holmes (1975), U.S. Pat. No. 3,785,163 issued to William Wagner (1974), and U.S. Pat. Nos. 3,916,641 and 3,996,765 both issued to John W. Mullins (1975).

The Olson patent discloses an external tool for the removal of Schrader type (depressing) valves. It is not installed in the system and does not have a main flow shut-off valve and it does not contain a by-pass mechanism to gain access to the system.

The device of the Holmes patent has an access port with a Schrader valve, which the preferred embodiment of this invention eliminates. It does not have a shut-off valve on the access port. The valve access is not upstream of the main shut-off valve and, therefore, a technician cannot isolate the refrigerant upstream of the main shut-off valve to perform a by-pass operation. It also has only one shut-off valve in the refrigerant flow line.

The Wagner patent discloses a refrigerant charging means and method for charging a saturated vapor refrigerant into the low pressure side of a refrigeration or air conditioning system. It discloses a portable external device which is not installed in the system, either at the factory or on-site at the location of the unit. It is a method of metering the charge. It does not allow a by-pass operation and does not allow the isolation of the evaporator or condenser sections of the systems in order that the location of leaks may be more easily ascertained.

The Mullins patents disclose a spring and cam shaft to depress a valve core, a Schrader valve, which can be eliminated in the preferred embodiments of the present invention. The Mullins patents disclose a portable external tool or device which is not an in-the-unit system and which does not have a double valve that allows a by-pass operation.

The present invention addresses and solves the above mentioned problems, when used with the prescribed techniques, and provides other advantages over the present means which will be further discussed below.

GENERAL DISCUSSION OF INVENTION

The present invention preferably:

(1) provides a simple, manually-operated, by-pass valve that eliminates the "Schrader" type valve;

(2) is installed in the refrigeration unit, thereby eliminating any external-type devices that are portable and prone to be misused or unused, such as in the hands of unscrupulous, "so-called" technicians;

(3) prevents the emission of the refrigerant, practically eliminates the loss of refrigerant fluid when entering or exiting the refrigeration system, some of which "gases" typically contain chlorofluorocarbon (CFCs) and hydrochlorofluorocarbons (HCFCs) and which, when allowed to escape into the atmosphere, cause ozone depletion and may injure the technician servicing the system or other persons close-by through inhalation of the refrigerant, "frost bite" or bums caused by the escaping refrigerants;

(4) allows, through the by-pass valve, the refrigeration technician to place all of the refrigerant fluid in the condenser unit, which then can be transferred to the evaporator section of the system, thus allowing the repair or work on either section separately;

(5) also allows an independent vacuum processing of the condenser or the evaporator sections of the system in order to be able to more easily locate leaks in the system; and (6) allows the evacuation of the refrigerant fluid from the hose between the standard gauge and the manifold access port of the by-pass valve.

The present invention further eliminates "easy access" to a system, thereby forcing a mechanic to enter-/exit a system with a manual front seat (by-pass) valve, safely, thereby eliminating potentially dangerous "short cuts," saving the environment and improving energy use and eliminating or at least substantially reducing the waste of refrigerant. The by-pass valve of the invention allows continuous operation of the system while entering and/or exiting the system without a system shutdown.

It is less complicated and less risky than using a pump-down process required with two standard/Schrader type front seat service valves (liquid & suction). It also eliminates the process tube silver solder joint on the exit of the present front seat valves and, when used on a suction line, it also eliminates the process tube to the compressor.

A first exemplary embodiment of the by-pass valve provided in this invention includes a generally rectangular cast body provided with parallel, longitudinal passageways, which are intersected by a third passageway which preferably is transverse to the other two, i.e., at a ninety (90°) degree angle to the parallel passageways, upstream of the shut-off seat of the main flow valve, and provides a by-pass shut-off service port for communication with the refrigerant system through a manifold service gauge (high, low and refrigerant drum connections for hoses). The embodiment also provides a "Schrader" less (non-depressing valve core) shut-off valve with an access port threaded connection for the standard refrigerant hose and a dust cap when closed and not in use.

The main objective of this invention is to provide an improved, safe, efficient and environmentally protective valve device that is installed in the refrigeration system (liquid and suction lines in the condensing unit) as a means to enter or exit the closed system and service the refrigeration system.

The invention and its related system are subject to many possible changes and/or alternatives (an exemplary one of which is shown in FIGS. 4 & 5), but such modifications would not alter or defeat the intentions as described or as illustrated in the drawings herein, thereby not limiting or confining same to the details of the preferred or exemplary embodiments shown.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

MODES FOR CARRYING OUT THE INVENTION

Figure 1:
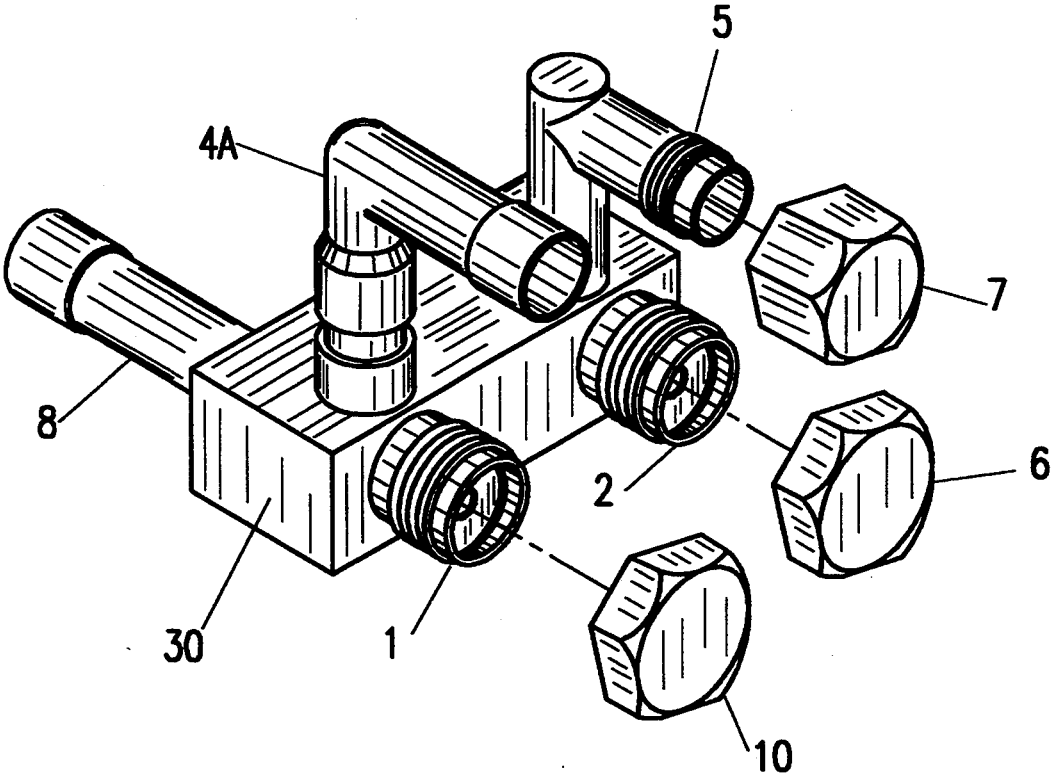
FIG. 1 is a perspective view of the first, preferred embodiment of the bypass valve system of the present invention.

Structural Details of 1st Embodiment (FIGS. 1+)

Figure 2:
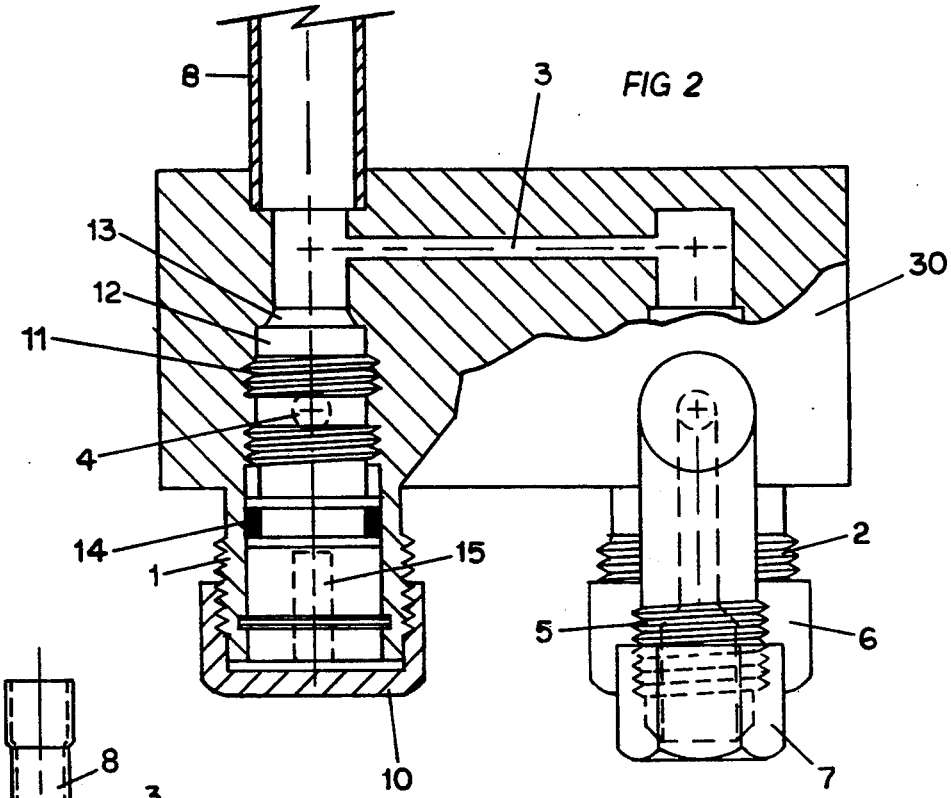
FIG. 2 is a plan view, partially cut-away, of the embodiment of FIG. 1.
Figure 3:
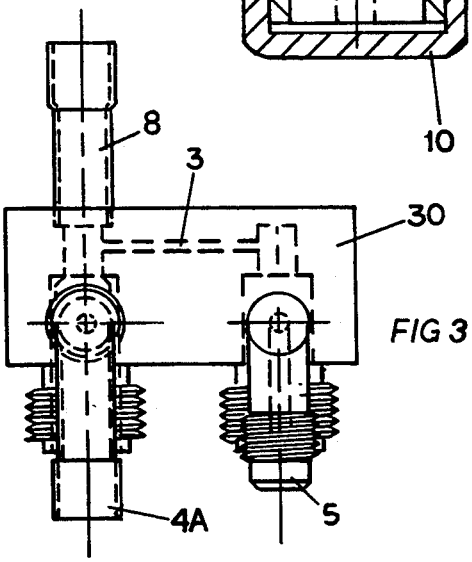
FIGS. 3, 3A & 3B are plan, side and front views, respectively, of the embodiment of FIG. 1.
Figure 3B:
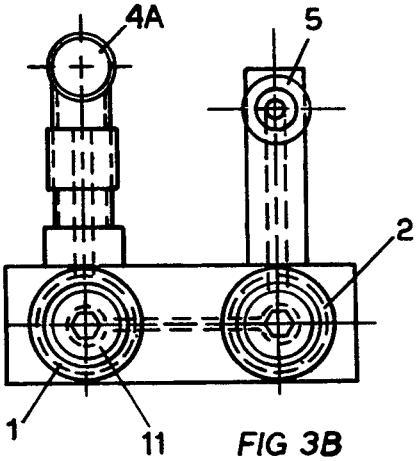
Figure 3A:
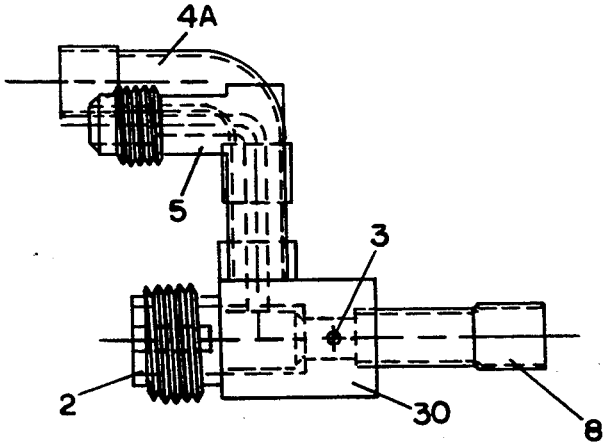

As illustrated in FIGS. 1–3B, the first embodiment 30 of the by-pass valve system of the invention includes a threaded liquid shut-off valve 1 (which is a simple, manually operated, cut-off valve) and a parallel, charging port, threaded shut-off valve 2, with an internal, by-pass connection tubing or passageway 3 (note FIG. 2) laterally extending between them. As can be seen in FIG. 2, the proximal end of the internal passageway 3 is located upstream at the intersection of the tubing and the seat of valve 1, while its distal end portion is connected to the back of the valve 2.

As can be further seen in FIG. 2, the core of the liquid shut-off valve 1 includes a valve stem operator 11, a valve seat 12, outlet stub-out 4A, a seat end 13, inlet 8, the access port 5 for hoses, "O" rings 14, and a female Allen end 15. For simplicity sake the internal details of valve 2 are not shown in FIG. 2 because they are substantially identical to the valve 1.

Figure 4:
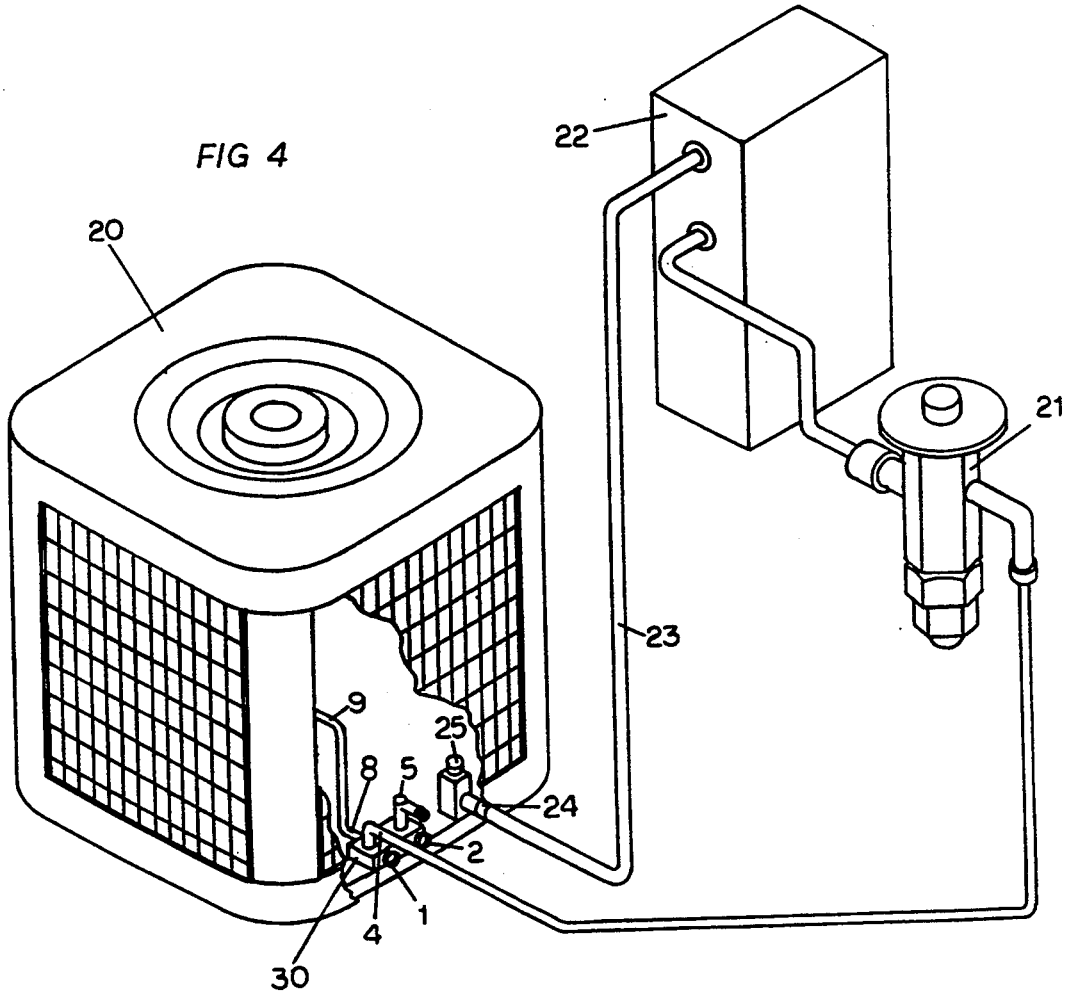
FIG. 4 is a generalized, perspective view of an exemplary refrigeration system with the by-pass valve system of the present invention illustrated in FIGS. 1 through 3B connected to the high pressure side of the condenser in line with the evaporator coils.

The by-pass system 30 further includes a threaded access port 5 associated with but downstream from the shut-off valve 2 and a stub-out field connection 4A for the liquid line 4 (see FIG. 4). The threaded male connection on the access port 5 is provided for connection to a standard type gauge hose used by refrigerant technicians.

Due to the presence of the interconnecting passageway 3, the back side of the liquid shut-off valve 1, the back side of the charge port, shut-off valve 2, the stub-out line 4A and the access port 5 for the valve 2 can all be exposed to the same internal pressure, with the back-sides of the valves 1 and 2 always being exposed to the passageway line 3 and the line 4 and port 5 being exposed to the passageway 3 when its respective valve 1,2 is open. However, when the valve 1,2 are closed, the line 4 and port 5, each being downstream from its respective valve, are isolated from the passageway 3. Thus, when valve 1 is front seated (i.e. closed), the refrigerant fluid cannot exit valve 1 at the field connection 4A but will be allowed a passageway to the by-pass connection tubing 3.

Thus, the valves 1,2, port 5 and the stub-outs 4 and 8 all extend out from the basic main body of the manifold 30, past its inner and outer sides, all through their internal back-ends in direct or indirect communication with the internal passageway bore 3.

Further included in the by-pass valve 30 are valve caps 10 & 6 for shut-off valves 1 & 2, respectively, and a dust cap 7 for access port 5, all for use when the valves and access port are not being used. An inlet connection 8 (stub-out) is provided for connection to the upstream high pressure liquid line 9, which goes to the high side of the compressor unit 20, note FIG. 4). The connection between the inlet stub-out connection 8 to the line 9, as well as the outlet stub-out connection 4A to the downstream liquid line 4, can be made by a flange, compression or flare fitting or, as illustrated, by silver solder.

As can be seen in the exemplary application of FIG. 4, which includes an exemplary refrigerant system in the form of a standard type air conditioning system, the double valve by-pass device 30 of FIG. 1 is connected through inlet stub-out 8 into the liquid flow line 9 to the condenser. This allows the compressed liquid or refrigerant to enter the valve 1 when it is back seated, and exit through stub-out line 4A, which serves as the field connection for the liquid line to the evaporator 22.

As can be further seen in FIG. 4, other standard components of the refrigeration system include the condenser 20, the downstream liquid line 4 to the evaporator expansion valve 21, the evaporator coil 22, a suction line 23 exiting the evaporator and connecting to the condensing unit at a suction shut-off valve 24, a suction line access port 25 and a suction line return 10 to the compressor. Suction shut-off valve 24 can be, for example, any standard back seat valve, but preferably one without a "Schrader" fitting.

When the shut-off valve 1 is back seated (open), refrigerant fluid in line 9 can enter valve 1 at stub-out 8 and exit at stub-out outlet 4A into downstream line 4. When the dust cap 7 is removed and a charging hose is connected to access port 5, and the valve 2 (normally front seated and closed) is back seated (opened) and the valve 1 is front seated (closed), access to the refrigeration line is obtained. The system can then be charged with refrigerant liquid into the high side while the condenser is under a vacuum and the unit is in an "off" position. In this mode the pressure can be tested or other procedures, as explained below, can be performed.

Figure 5:
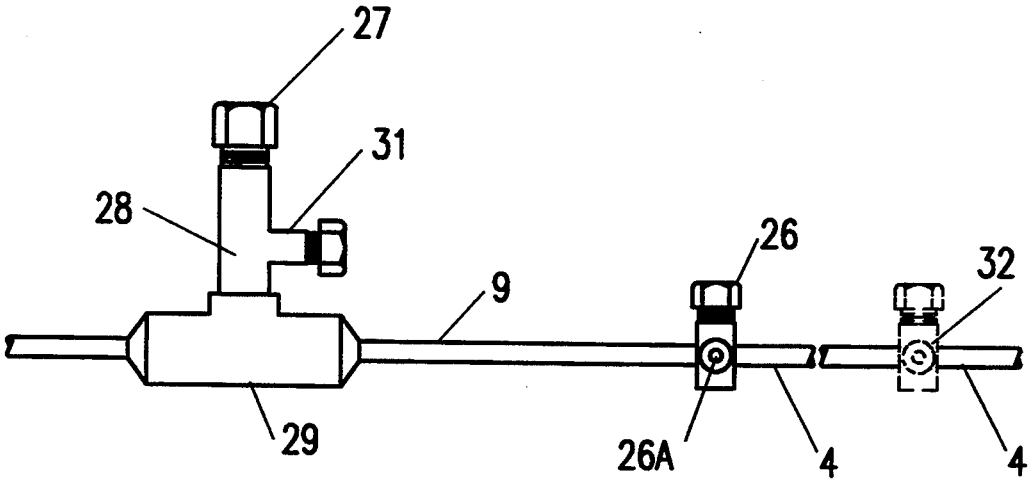
FIG. 5 is a side view of an alternative, second, exemplary embodiment of the by-pass valve system of the invention, which is based on an approach of making a by-pass connection achieving similar results as that of the embodiment illustrated in FIGS. 1+, but having two, independent, separated, spaced, valve structures connected in-line through a "T" and which use the same basic operating, by-pass principles as the first embodiment does.

Structural Details of Alternate, "In-Line" Embodiment (FIGS. 5+)

The two embodiments of FIGS. 1+ and FIGS. 5+ are functionally very similar, using the same or very similar operational features. Thus, it is noted that, in the alternate embodiment of FIGS. 5 & 6, valves 26 and 27 functionally correspond to valves 1 and 2 of FIG. 1, while manifold 28 intersecting the liquid line 9 with a "tee" (T) at flow-through section 29 and that part of line 9 between section 9 and valve 21 functionally corresponds to the transverse manifold or passageway 3 of FIG. 2. Additionally, threaded access port 31 for valve 27 corresponds to access port 5 for valve 1 in FIGS. 1+. The other elements of the refrigerant system, namely elements 20–25 of FIG. 4, can be the same.

As can be seen in FIG. 5, the first valve manifold 27/28/31 and the second valve manifold 26 are connected in the upstream refrigerant liquid line 9 in line with each other, with the valve manifold 26 then exiting into the downstream liquid line 4. This second embodiment uses the two independent valves 27 & 26 connected by the "tee" (T) 28/29 to the upstream, adjacent portion of the refrigerant liquid line 9 to form the by-pass between the two valves on the refrigerant liquid line 9.

The downstream valve 26 is typically already installed in standard compressor designs and typically will have a side port 26A, which is unused after the manifold 27/28/31 of the invention has been installed. The unused port 26A should be tagged or otherwise marked "not to be used" for future servicing. As can be seen in FIG. 5, a supplemental valve 32 can be added as a retro-fit in the line 4 to perform certain additional servicing functions, as detailed below.

Figure 6:
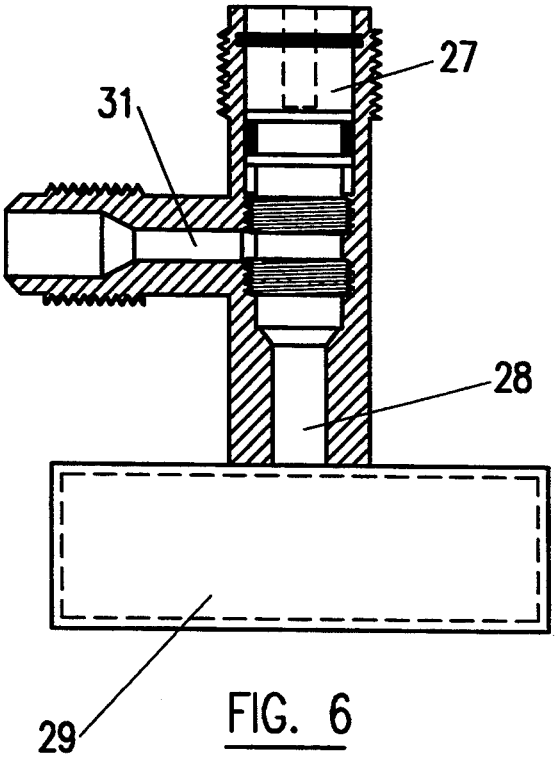
FIG. 6 is a side view, partially in cross-section, of the main part of the alternate by-pass valve system of FIG. 5 by itself, taken from the other side of the figure, i.e., rotated by one hundred and eight (180°) degrees.

It is noted that the alternate approach of FIGS. 5 & 6 probably would be more expensive to manufacture and install than the single unit of FIG. 1+, when considered as retro-fitted units. The first embodiment was primarily designed to be included during the manufacturing of the compressor unit, for example, the compressor unit 20, rather than as a retro-fit system, while the second embodiment is primarily designed for a retro-fit situation.

Operation

Referring now to various, exemplary operations which can be performed by the use of the "in-line by-pass valve" or with the set-up of connecting valves as depicted in FIG. 5, and the methodology of the invention, five exemplary operations will described in detail, namely:

A. Entering system for testing and/or charging and exiting the system;
B. An "in-line valve" vacuum process;
C. Storage and transfer of refrigerants;
D. Temporary valve downstream to perform method "C"; and
E. Transfer and store the refrigerant by a line tap valve.

A. ENTERING SYSTEM FOR TESTING AND/OR CHARGING AND EXITING THE SYSTEM

The technician will need, in order to perform this operation, the following tools and accessories—standard refrigeration high side/low side gauges with charging hoses, and Allen socket drives with rachet wrench and refrigerant drum. The manifold high/low gauges should include an adapter with a two valve connection for refrigerant drum and vacuum tank hoses.

With the unit in operation, the high pressure gauge hoses are attached to the access port 31, or charging port valve 28 of the "in-line valve" liquid line valve. The low pressure gauge hose is connected to the suction port valve 24 (see FIG. 4), and the gauge manifold adapter hose is connected to the refrigerant source or drum valve, and the second adapter hose is connected to the vacuum tank.

With the existing unit liquid line shut-off valve 26 open in its back seated position, the charging port valve 27 back seat is opened to read the high side pressure of the system.

To exit the system, the port shut-off valve 27 is front seated (closed) and the drum valve closed, the high side gauge valve and the low side gauge valve are opened to induce the refrigerant back into the low side of the system. The high side gauge valve is shut off first and then the low side valve is shut off. Then both charging port valves (high and low) are secured in normal operation position by front seating said valves into a closed position. Then the gauge hoses are "bled" into the vacuum tank.

B. THE "IN-LINE VALVE" VACUUM PROCESS

1. Entire System, When the System is Devoid of Refrigerant

One first should make certain that the valve 26 is in the normal open, or back-seated position.

The technician should then go through the same process of connecting the hoses as on the testing and charging procedure ("A" above), except that the drum hose is attached to the vacuum pump inlet.

The manifold high/low gauges should include an adapter with a two valve connection for refrigerant drum and vacuum tank hoses.

Access port valve 27 should then be opened (back seated), and the suction charging port valves 25 opened. The lines should be vacuumed, and, after the process is completed, the charging hose is attached to the refrigerant drum valve and, with both gauge valves closed, the drum valve is opened to purge the charging hose into the vacuum tank. This allows the refrigerant to be added to the system as a liquid through the liquid line side, with the unit off, or as a vapor through the low side with the unit in operation.

2. Vacuum on Separate High or Low Sides a) High Side Vacuum

To pull the vacuum on the condensing unit side only (with the charging hose connected to the vacuum pump), the liquid line shut-off valve 26 is front seated (closed) and the charging port valve 27 is back seated (open) with the suction line valve 24 (see FIG. 4) closed (front-seated).

b) Low Side Vacuum

To pull the vacuum on the evaporator side from liquid line condensing unit shut off valve 26 through the expansion valve to the suction line service valve entrance or access port 25, the liquid line shut-off valve 26 is front seated (closed) with the suction line valve 24 in a closed position (front-seated) and the access port valve 25 opened and used to pull a vacuum through.

c) To Exit the System and Return to Normal Operating Position

After the unit has been vacuumed, charged and tested, the valves should be returned to their normal operation positions, i.e., valve 26 open (back-seated), and charging port valve 27 & 25 closed (front-seated). If valve 25 is on a standard back seat valve, it must be back seated to close it.

With the refrigerant drum valve closed, the liquid line valve 26 is back seated (open) and the liquid line port valve 27 is front seated (closed). The suction line valve 24 is quarter ($\frac{1}{4}$) turn off back seated on a standard back seat valve, and the gauge valves are opened (high side first, then suction gauge hose valve to induce the remaining refrigerant in the hoses into the system). Then, the suction charging port valve 25 is front seated or a standard back seat valve is back seated to the closed position. Then any refrigerant residue is bled into the vacuum tank, and all hoses are disconnected as the process is then complete, if a by-pass valve is being used on the suction line in lieu of a standard back seat valve.

C. STORAGE AND TRANSFER OF REFRIGERANT

With the unit in operation, in order to salvage the refrigerant in the system, when repairing or replacing the condensing unit section of a system, the procedure is as follows:

Gauges are attached to respective high, low and refrigerant drum connections, and, after purging the hoses into the vacuum tank, the refrigerant drum valve is closed (front-seated).

With the liquid line valve 26 closed (front-seated), the liquid charging port shut-off valve 27 is opened (back seated) on the "in-line valve", and the pressure on the manifold high side gauge is read, while reading the suction pressure on access port 25.

The suction line service valve 24 is closed (from seated) after the pump down of the refrigerant into the condensing unit 20, if it has an "old-time" service valve charging port, or, if the suction valve 24 has a "Schrader type" fitting, the Schrader core is removed. The condensing unit is shut off after pumping down the refrigerant into the condenser.

The evaporator side of the system is pulled on a vacuum through the suction port (with the Schrader core removed).

With the drum and vacuum tank valves closed, the high side gauge valve is opened; then the low side gauge valve is opened, allowing the refrigerant to flow through the gauge manifold into the suction line at 25 of line 23 into the evaporator. When the liquid refrigerant has flowed into and filled the evaporator and the liquid and suction lines, the manifold gauges and liquid line port valve 27 are closed (front-seated).

If possible, the refrigeration unit is run to pump the refrigerant into the evaporator side (through the suction line 23 at access port 25).

If the unit is unable to run, in order to store the liquid refrigerant in the evaporator section of the system, an auxiliary refrigerant pump, or reclaim/recovery unit can be used.

If any refrigerant remains in the condensing unit section, an empty D.O.T. refrigerant drum can be evacuated on a vacuum and the remaining refrigerant induced into the drum (or a recovery/reclaim unit could be used).

After the repairs are completed, the liquid line valve 26 is opened, allowing the refrigerant to migrate back into the condenser from the evaporator.

When the pressure equalizes on both sides of the system (condenser/evaporator), the suction service valve 24 must be opened to allow the unit to be operational. With the unit running, the refrigerant charge can be balanced.

When refrigerant is in a system with a compressor "burn out", the entire charge will have to be filtered and passed through a reclaiming process. After filtering, the refrigerant will have to be tested to determine if its properties are still retained in order to reuse same, as per E.P.A. standard regulations.

It is noted that with units and/or chillers with two (2) or more compressors/circuits, these extra evaporator sections can be utilized as storage containers in lieu of additional D.O.T. cylinders and with a much shortened time to perform the recovery process. One should, of course, take an oil sample prior to transfer into another evaporator section.

D. TEMPORARY VALVE DOWNSTREAM TO PERFORM METHOD "C"

The refrigerant should be stored and transferred when repairing/replacing condensing unit components in the refrigeration circuit and/or installing either the original "Hubbell-Double" TM valve (FIGS. 1+) or the "in-line" alternate valve (FIG. 6), i.e., field retro-fitted.

The liquid and/or vapor refrigerant should be removed and/or transferred prior to making repairs or replacements to the condensing unit section and minimize the loss of refrigerant to the "lowest achievable level", as well as, reducing the use of a recovery machine and D.O.T. cylinders, thus reducing costs in time and materials.

The procedure is as follows:

1. The existing liquid line service valve 26 is shut to a closed position, front seated.
2. The liquid and vapor refrigerant are pumped into the condenser coils.
3. The liquid line 4 is cut downstream of the existing liquid line service valve 26 and upstream of the evaporator section expansion device 21, preferably just outside the condensing unit, for easy access.
4. Then a temporary liquid line shut off valve 32 is installed.
5. A vacuum is pulled on the evaporator section, including the liquid line and suction line to 24 with both valve (FIG. 1) and 25 closed, front seated.
6. Then the front seat temporary valve 32 is closed.
7. The existing liquid line valve 26 is opened, which becomes a temporary in-line device and allows refrigerant to flow through port **26*a* of the FIG. 5 type valve while entering the high side open manifold gauge valve through the open low side manifold valve gauge with drum and vacuum adapter hoses in a closed position, thus transferring the liquid refrigerant into the suction line in the opposite direction of normal flow while filling the liquid line 4, evaporator 22 and suction line 23** with the condensed liquid charge. When liquid charge ceases to flow and be transferred by vacuum/-gravity, both high and low side manifold valves are closed.
8. A refrigerant pump and/or recovery machine is used to condense the remaining vapors into a D.O.T. vacuum tank/cylinder. This residue can be recovered in shop by a reclaim/recovery machine with a storage tank.
9. After the repairs are completed to the condensing unit section 20, a new "Hubbell-Double" FIG. 1 liquid line type valve or an "in-line" valve 28 upstream of the existing liquid line valve 26 is installed, the temporary liquid line valve 32 is then removed outside of the condensing unit in line 4 and the same is reconnected.
10. If a "Hubbell-Double" valve of the type of FIG. 1 is installed, the existing liquid line valve 26 is also removed.
11. If an "in-line" valve 28 is installed upstream of the existing liquid line service valve 26, only the temporary valve 32 is removed and line 4 reconnected.
12. Then pull the condensing unit section 20 on a vacuum by opening the liquid line valve 27 or the valve 1 of FIG. 1 through the access port 31 of an "in-line" valve or through the access port 5 of FIG. 1.
13. When the vacuum process is completed, open whichever valve (valve 1 of FIG. 1 or valve 26 of FIG. 5) was used in the vacuum process, allowing the liquid refrigerant to flow back into the high side of the condensing unit, until the flow stops and the pressures equalize.
14. Then the refrigeration unit can be run and operated, and fully charged and balanced with refrigerant as needed.
15. The method process is then completed.

E. TRANSFER AND STORE THE REFRIGERANT BY A LINE TAP VALVE

Another method of operation to transfer and store the refrigerant from the condenser into the evaporator section of a refrigeration/air conditioning system, that is operable but requires some condenser repairs.

This operation comprises the following steps:

1. A temporary line tap valve is installed into the liquid line 8 inside the condensing unit and ahead of, upstream of, the existing liquid line shut-off valve 26.
2. This line tap valve serves as a temporary in-line valve, and the methods of operation are identical to the above A, B, C methods described above for the "in-line" type of valve (FIG. 6).
3. After the transfer of the refrigerant into the evaporator and repairs are completed to the upstream side of the existing liquid line shut off valve 26, the temporary line tap valve is removed and a retro-fit "in-line" valve 28 (FIG. 6) is installed, and the steps of the "in-line" methods are followed to return the system back to normal operation.

It is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

I claim:

1. Two independent valve manifolds providing a means for a by-pass of the shut-off valve in the main flow refrigerant line between the condenser and evaporator coils of a closed refrigeration system, comprising, a longitudinal main flow manifold containing a manually operated shut-off valve through which compressible evaporative refrigerants flow between the condenser and evaporator coils of a closed refrigeration system and having an entrance and exit to a passageway for the flow of said refrigerant through the said manifold and comprising, a second longitudinal manifold containing a manually operated shut-off valve that is generally parallel to the said firstly described main flow manifold and shut-off valve with an external threaded access port thereon, without a Schrader valve core therein, extending from said second longitudinal manifold, and by means of a tee in the main flow refrigerant line, the refrigerant line connects the first and second manifold valves on the upstream side of the seats thereof, which provides a means to infuse in and to extract refrigerants from a closed refrigeration system through the threaded access port of the secondly described manifold, and then through the tee that intersects the main flow refrigerant line upstream of the seat of the firstly described shut-off manifold valve, allowing a by-pass of the main flow shut-off valve.

2. A method of storing and transferring refrigerants into either the condenser or evaporator section of a closed refrigeration or air conditioning system having a compressor, a condenser on the high pressure side of the compressor, an evaporator on the low pressure side of the compressor and a double valve manifold on the refrigerant liquid line connected with a by-pass tubular connection thereof on the upstream side of the valve seats thereof, comprising the steps of:

a. with the unit in operation, in order to salvage the refrigerant in the system, when repairing or replacing the condensing unit section of a system, attach gauges to respective high, low and refrigerant drum connections, and, after purging the hoses into the vacuum tank, close the refrigerant drum valve and, with the liquid line valve closed, open the liquid charging port shut-off valve and read the pressure on the manifold high side gauge and the suction line pressure on the suction access port valve, and then close the suction line service valve and, after transferring the refrigerant into the condensing unit, close the suction service valve and turn the condensing unit off, and b. in order to transfer the liquid refrigerant from the condenser into the evaporator side of the system the operator will then vacuum the evaporator side of the system through the suction port, with the drum and vacuum tank valves closed and open the high side gauge valve, then the low side gauge valve and, allowing the liquid refrigerant to flow through the gauge manifold into the suction line and into the evaporator, and when the liquid refrigerant has flowed into and filled the evaporator and the liquid and suction lines, operator will close the manifold gauges and liquid line port valve, and c. if the unit is unable to run, in order to store the liquid refrigerant in the evaporator section of the system, use an auxiliary refrigerant pump, or reclaim unit, and d. if any refrigerant remains in the condensing unit section, evacuate an empty approved refillable refrigerant drum on a vacuum and induce the remaining refrigerant into the drum, or use a reclaim unit, and e. after the repairs and/or replacements are completed, open the liquid line valve to allow the refrigerant to migrate back into the condenser from the evaporator, and f. when the pressure equalizes on the condenser and evaporator sides of the system, open the suction service valve to allow the unit to be operational, and, with the unit running, the refrigerant charge can be balanced, and g. when the refrigerant is in a system with a compressor "burn out" the entire charge is filtered and passed through a reclaiming process and then tested to determine if its properties are still retained in order to reuse same.

3. In a refrigerant system having a condenser and evaporator coils operating in a generally closed refrigeration system and having a main flow refrigerant line for transferring refrigerant between the condenser and the evaporator coils, the improvement comprising:

a by-pass valve sub-system included in-line between the condenser and the evaporator coils, comprising two, independent, valve manifolds serving as a by-pass of the main shut-off valve, including a first, longitudinal, main flow manifold containing a first, manually operated shut-off valve having a seat through which compressible evaporative refrigerants can flow between the condenser and evaporator coils of a closed refrigeration system and having an entrance and exit to a passageway for the flow of the refrigerant through it, and a second longitudinal manifold containing a second, manually operated shut-off valve having a seat and being operationally parallel to said first shut-off valve, and further having an access port thereon, without a Schrader valve core therein, extending from said second manifold; and a "T" in the main flow refrigerant line, said "T" connecting the refrigerant line to said first and second valve manifolds on the upstream sides of the valve seats thereof, providing a means to infuse in and to extract refrigerants from a closed refrigeration system through said access port of said second manifold, and then through the "T", allowing a by-pass of the main flow shut-off valve.

4. A method of storing and transferring refrigerants into either the condenser or evaporator sections of a closed refrigerant system having a compressor, a condenser on the high pressure side of the compressor, an evaporator on the low pressure side of the compressor and two independent valves on the refrigerant liquid line connected with a by-pass tubular connection thereof on the upstream side of the valve seats thereof by means of a "T", comprising the steps of:

a. with the unit in operation, in order to salvage the refrigerant in the system, when repairing or replacing the condensing unit section of a system, attaching gauges to respective high, low and refrigerant drum connections, and, after purging the hoses into the vacuum tank, closing the refrigerant drum valve and, with the liquid line valve closed, opening the liquid charging port shut-off valve and reading the pressure on the manifold high side gauge and the suction line pressure on the suction access port valve, and then closing the suction line service valve and, after transferring the refrigerant into the condensing unit, closing the suction service valve and turning the condensing unit off, and b. in order to transfer the liquid refrigerant from the condenser into the evaporator side of the system, vacuuming the evaporator side of the system through the suction port, with the drum and vacuum tank valves closed, and opening the high side gauge valve, then the low side gauge valve, and allowing the liquid refrigerant to flow through the gauge manifold into the suction line and into the evaporator, and, when the liquid refrigerant has flowed into and filled the evaporator and the liquid and suction lines, closing the manifold gauges and liquid line port valve;

c. if the unit is unable to run, in order to store the liquid refrigerant in the evaporator section of the system, using an auxiliary refrigerant pump, or reclaim unit;

d. if any refrigerant remains in the condensing unit section, evacuating an empty, refillable refrigerant drum on a vacuum and inducing the remaining refrigerant into the drum, or using a reclaim unit;

e. after the repairs and/or replacements are completed, opening the liquid line valve, allowing the refrigerant to migrate back into the condenser from the evaporator;

f. when the pressure equalizes on the condenser and evaporator sides of the system, opening the suction service valve, allowing the unit to be operational, and, with the unit running, balancing the refrigerant charge; and g. when the refrigerant is in a system with a compressor "burn out", filtering and passing the entire charge through a reclaiming process.

5. In a closed refrigerant type system including a compressor, an evaporator coil and a high pressure liquid refrigerant line between the condenser and the evaporator coil through which compressible evaporative refrigerant flows between the condenser and the evaporator coil, the improvement of enhancing the servicing of the refrigerant system comprising:

a double valve manifold sub-system installed in the high pressure line between the compressor and the evaporator coil and having a first manually operated shut-off valve (1/26), with open and closed dispositions, a second manually operated shut-off valve (2/27), with open and closed dispositions, a by-pass passageway (3, 28/29/9), including a proximal end and a distal end portion, extending between and interconnecting said first and said second manually operated valves, with said proximal end connected to said first, valve and said second valve connected to said distal end portion of said passageway, and a port (5, 31) connected to said distal end portion of said passageway, further downstream than said second manually operated valve, allowing all of the refrigerant from the compressor to flow through the high pressure line potentially to the evaporator coil and not through said port when said first valve is in its open disposition and said second valve is in its closed disposition, but causing any refrigerant from the compressor to flow through said by-pass passageway out said port into an outside line connected to said port and not through said high pressure line when said first valve is in its closed disposition and said second valve is in its open disposition.

6. The improvement of claim 5 wherein neither of said first and second valves nor said port include a Shrader-type valve.

7. The improvement of claim 5 wherein said valves and said port each have an internal back-side, and wherein there is further included:

a basic manifold body with an internal bore (3), with said first and second valves and said port extending out from said basic manifold body, with the internal back-sides of said valves in communication with said bore and with the internal side of said port being in communication with said bore when said second valve is open, and with said bore forming at least in part said passageway.

8. The improvement of claim 7, wherein said basic body has inner and out sides, and wherein there is further included:

an inlet stub (8) and an outlet stub (4) extending out from said basic body past said inner and said outer sides, respectively, with said inlet stub connected in line with an upstream end of said high pressure line and said outlet stub connected to a downstream end of said high pressure line, said outlet stub being connected to said passageway through said first valve and being in communication with it when said first valve is opened, interconnecting the upstream and the downstream ends of said high pressure line.

9. The improvement of claim 5, wherein at least said second valve and said port have male threaded outer ends, and wherein there is further included:

a set of at least three, female threaded caps, with each one being threadingly engageable with a respective one of said male threaded outer ends, closing its respective end off.

10. The improvement of claim 5, wherein said first and said second valves are separated from each other with an interconnecting section of the main line between them (FIG. 5) and said second valve and said port each have an internal back-side, and wherein there is further included:

a basic manifold body with an internal bore (28), with said second valve and said port extending out from said basic manifold body, with the internal back-side of said second valve in communication with said bore, and with the internal back-side of said port being in communication with said bore when said second valve is open, and with said bore and the interconnecting section of the main line in combination forming at least in part said passageway.

11. A method of enhancing the servicing of a closed refrigerant type system including a compressor, an evaporator coil, and a high pressure liquid refrigerant line between the condenser and the evaporator coil through which compressible evaporative refrigerant flows between the condenser and evaporator coil, comprising the following step:

installing in the high pressure line between the compressor and the evaporator coil a double valve manifold system having a first manually operated shut-off valve (1/26) with open and closed dispositions, a second manually operated shut-off valve with open and closed dispositions, a by-pass passageway (3, 28/29/9), including a proximal end and a distal end portion, extending between and interconnecting said first and said second manually operated valves, with said proximal end connected to said first valve, and said second valve connected to said distal end portion of said passageway, and a port (5, 31) connected to said distal end portion of said passageway, further downstream than said second manually operated valve, allowing all of the refrigerant from the compressor to flow through the high pressure line potentially to the evaporator coil and not through said port when said first valve is in its open disposition and said second valve is in its closed disposition, but causing any refrigerant from the compressor to flow through said by-pass passageway out said port into an outside line connected to said port and not through said high pressure line when said first valve is in its closed disposition and said second valve is in its open disposition.

12. The method of claim 11, wherein there is included the further sub-step of:

incorporating said valves and said port into a basic manifold body with an internal bore (3/FIG. 1), with said first and said second valves and said port extending out from said basic manifold body, with the internal back-side of said valves in communication with said bore and with the internal back-side of said port being in communication with said bore when said second valve is open, and with said bore forming at least in part said passageway.

13. The method of claim 11, wherein there is included the further sub-steps of:

separating said first and said second valves from each other with an interconnecting section of the main line between them (FIG. 5); and incorporating said second valve and said port into a basic manifold body with an internal bore (28), with said second valve and said port extending out from said basic manifold body, with the internal back-side of said second valve in communication with said bore, and with the internal back-side of said port being in communication with said bore when said second valve is open, and with said bore and the interconnecting section of the main line in combination forming at least in part said passageway.

* * * * *